US009707444B1

(12) United States Patent
Danford

(10) Patent No.: US 9,707,444 B1
(45) **Date of Patent: *Jul. 18, 2017**

(54) RESISTANCE BREATHING DEVICE

(71) Applicant: TrainingMask L.L.C., Cadillac, MI (US)

(72) Inventor: Casey Danford, Cadillac, MI (US)

(73) Assignee: TrainingMask LLC, Cadillac, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/077,567

(22) Filed: Mar. 22, 2016

(51) Int. Cl.
*A63B 23/18* (2006.01)
*A63B 21/00* (2006.01)

(52) U.S. Cl.
CPC ..... *A63B 23/18* (2013.01); *A63B 21/4003* (2015.10)

(58) Field of Classification Search
CPC . A63B 21/0085; A63B 21/0088; A63B 23/18; A61M 16/00; A61M 16/0093; A61M 16/0468; A61M 16/06; A61M 16/20
USPC ..... 482/13
See application file for complete search history.

(56) References Cited

U.S. PATENT DOCUMENTS

| | | | | |
|---|---|---|---|---|
| 938,247 | A | 10/1909 | Kuhn | |
| 3,097,642 | A | 7/1963 | Russell | |
| 3,633,575 | A | 1/1972 | Brumfield | |
| 3,850,171 | A | 11/1974 | Ball et al. | |
| 4,064,876 | A | 12/1977 | Mulchi | |
| 4,221,381 | A | 9/1980 | Ericson | |
| 4,549,543 | A | 10/1985 | Moon | |
| 4,601,465 | A * | 7/1986 | Roy | A63B 23/18 128/207.16 |
| 4,739,987 | A | 4/1988 | Nicholson | |
| 4,770,413 | A | 9/1988 | Green | |
| 4,961,420 | A | 10/1990 | Cappa et al. | |
| 4,973,047 | A | 11/1990 | Norell | |
| 5,117,821 | A | 6/1992 | White | |

(Continued)

FOREIGN PATENT DOCUMENTS

| | | |
|---|---|---|
| CN | 3416108 | 12/2004 |
| CN | 3525464 | 5/2006 |

(Continued)

OTHER PUBLICATIONS

Utility U.S. Appl. No. 14/951,837, filed Nov. 25, 2015, entitled "Resistance and Filtration Breathing Device" (39 pages).

(Continued)

*Primary Examiner* — Sundhara Ganesan
*Assistant Examiner* — Jennifer M Deichl
(74) *Attorney, Agent, or Firm* — Greenberg Traurig, LLP

(57) ABSTRACT

A resistance breathing device includes a face mask having a perimeter and a central aperture extending therethrough, and being adapted to overlay a user's mouth and nose such that the perimeter forms an air-tight seal with the user's face. An outer layer overlays the face mask and includes a pair of straps for affixing the face mask about a user's face. An insert plate is disposed within the central aperture of the face mask and has an inlet aperture extending therethrough. A central insert overlays the insert plate, has an air inlet aperture extending therethrough, and is movable between a first position in which a first portion of the air inlet aperture overlaps the air inlet aperture of the insert plate and a second position in which a larger second portion of the air inlet aperture overlaps the air inlet aperture of the insert plate.

20 Claims, 7 Drawing Sheets

(56) References Cited

U.S. PATENT DOCUMENTS

| | | | | |
|---|---|---|---|---|
| 5,167,819 | A | 12/1992 | Iana et al. | |
| 5,697,105 | A | 12/1997 | White | |
| 5,799,652 | A | 9/1998 | Kotliar | |
| 5,848,589 | A | 12/1998 | Welnetz | |
| 5,850,833 | A | 12/1998 | Kotliar | |
| 5,924,419 | A | 7/1999 | Kotliar | |
| 5,964,222 | A | 10/1999 | Kotliar | |
| 6,471,621 | B2 | 10/2002 | Hörstel et al. | |
| 6,508,850 | B1 | 1/2003 | Kotliar | |
| 6,554,746 | B1 | 4/2003 | McConnell et al. | |
| 6,606,751 | B1 | 8/2003 | Kalhok et al. | |
| 6,644,308 | B2 | 11/2003 | Kalhok et al. | |
| 7,523,755 | B2 | 4/2009 | Richardson et al. | |
| 7,931,733 | B2 | 4/2011 | Kotliar | |
| D645,956 | S | 9/2011 | Grimsley | |
| 8,365,734 | B1 | 2/2013 | Lehman | |
| 8,590,533 | B2 | 11/2013 | Danford | |
| D694,875 | S | 12/2013 | D'Souza et al. | |
| 9,067,086 | B2 | 6/2015 | Danford | |
| 2001/0007651 | A1 | 7/2001 | Fust | |
| 2001/0029750 | A1 | 10/2001 | Kotliar | |
| 2002/0023762 | A1 | 2/2002 | Kotliar | |
| 2002/0100893 | A1 | 8/2002 | Shultz | |
| 2002/0162556 | A1 | 11/2002 | Smith et al. | |
| 2004/0146842 | A1 | 7/2004 | Carlucci et al. | |
| 2004/0226563 | A1 | 11/2004 | Xu et al. | |
| 2008/0178884 | A1 | 7/2008 | Gerson et al. | |
| 2008/0202774 | A1 | 8/2008 | Kotliar | |
| 2008/0210240 | A1 | 9/2008 | Kotliar | |
| 2009/0320848 | A1 | 12/2009 | Steindorf et al. | |
| 2010/0101584 | A1 | 4/2010 | Bledstein et al. | |
| 2011/0212811 | A1 | 9/2011 | Rutten | |
| 2013/0319420 | A1 | 12/2013 | Danford | |
| 2015/0040907 | A1* | 2/2015 | Hakim | A61M 16/0683 128/205.24 |
| 2016/0089553 | A1 | 3/2016 | Dickstein et al. | |
| 2016/0129286 | A1* | 5/2016 | Danford | A62B 18/02 128/206.21 |
| 2016/0129287 | A1 | 5/2016 | Danford | |

FOREIGN PATENT DOCUMENTS

| | | | |
|---|---|---|---|
| CN | 300733965 | | 1/2008 |
| CN | 302560932 | S | 9/2013 |
| CN | 303312122 | S | 7/2015 |
| EP | 2 425 875 | A1 | 3/2012 |
| KR | 30-0514514 | | 12/2008 |
| KR | 30-0586700 | | 1/2011 |
| KR | 30-0778665 | | 1/2015 |
| WO | 00/04957 | A1 | 2/2000 |
| WO | 2010/127161 | A2 | 11/2010 |

OTHER PUBLICATIONS

Utility U.S. Appl. No. 14/989,400, filed Jan. 6, 2016, entitled "Resistance Breathing Device" (43 pages).

Design U.S. Appl. No. 29/544,300, filed Nov. 2, 2015, entitled "Resistance and Filtration Breathing Device" (7 pages).

Design U.S. Appl. No. 29/544,580, filed Nov. 4, 2015, entitled "Resistance Breathing Device" (7 pages).

Design U.S. Appl. No. 29/556,825, filed Mar. 3, 2016, entitled "Resistance Breathing Device" (6 pages).

International Search Report and Written Opinion dated Dec. 7, 2015, issued in International (PCT) Patent Application No. PCT/US2015/051364, filed Sep. 22, 2015 (15 pages).

Design Patent Right Evaluation Report dated Mar. 21, 2016, issued by the State Intellectual Property Office of China in Patent No. ZL201530349470.4 and English-language translation thereof (31 pages).

Printouts of Phantom Athletics website http://www.phantom-trainingmask.com/en/ advertising a resistance breathing device, accessed Jan. 26, 2016 (8 pages).

Photographs of a resistance breathing device, purchased Jun. 3, 2016, along with redacted invoice for such purchase (9 pages).

Printouts of Phantom Athletics website, archived by Archive.org, available at https://web.archive.org/web/20160129132023/http://www.phantom-trainingmask.com/en/phantom-trainingmask, accessed Sep. 1, 2016 (8 pages).

* cited by examiner

RESISTANCE BREATHING DEVICE

FIELD OF THE INVENTION

The present invention relates to wearable breathing devices. More particularly, the present invention relates to wearable breathing devices providing resistance to air inhalation.

BACKGROUND OF THE INVENTION

Individuals who are training for physical fitness or athletic competition may wish to improve the efficiency of their cardiovascular systems for improved health and stamina. More particularly, individuals may wish to condition their cardiovascular systems by performing training or exercise activities while restricting their ability to inhale air and oxygen.

SUMMARY OF THE INVENTION

In an embodiment, a resistance breathing device includes a face mask, an outer layer, an insert plate, a central insert, and an air exhaust valve assembly. The face mask has an interior surface, an exterior surface opposite the interior surface, an aperture extending through the face mask from the exterior surface to the interior surface, and a perimeter. The face mask is adapted to overlay a user's mouth and nose such that the perimeter forms an air-tight seal with the user's face and around the user's mouth and nose and the face mask defines an internal area between the interior surface of the face mask and the user's face. The outer layer overlays the face mask and has a pair of straps with inter-engaging ends for affixing the face mask about the user's face. The insert plate has an interior surface, an exterior surface opposite the interior surface of the insert plate, and at least one inlet aperture extending therethrough. The insert plate is disposed within the aperture of the face mask. The aperture of the face mask forms an air-tight seal around the insert plate. The central insert has an interior surface, an exterior surface opposite the interior surface of the central insert, and at least one inlet aperture extending therethrough. The central insert overlays the insert plate such that the interior surface of the central insert faces the exterior surface of the insert plate and such that at least a portion of the at least one inlet aperture of the central insert overlays the at least one inlet aperture of the insert plate. The central insert is movable with respect to the insert plate between at least a first position and a second position. When the central insert is in the first position, a first portion of the at least one inlet aperture of the central insert overlays the at least one inlet aperture of the insert plate. When the central insert is in the second position, a second portion of the at least one inlet aperture of the central insert overlays the at least one inlet aperture of the insert plate. The second portion of the at least one inlet aperture of the central insert is larger in size than the first portion of the at least one inlet aperture of the central insert. The air exhaust valve assembly is adapted to prevent air from passing therethrough from an external environment to the internal area of the face mask and allow air to pass therethrough from the internal area to the external environment.

In an embodiment, the central insert is movable rotationally about an axis of rotation and relative to the central insert. In an embodiment, the at least one inlet aperture of the inlet plate and the at least one inlet aperture of the central insert are circumferentially arrayed about the axis of rotation. In an embodiment, the insert plate includes a central aperture. The central insert includes a central aperture overlaying the central aperture of the insert plate and having a profile complementary to the central aperture of the insert plate, a biasing member extending across the central aperture of the central insert, and a stem extending from a center of the biasing member outwardly from the insert plate. In an embodiment, the air exhaust valve assembly includes the central aperture of the insert plate, the central aperture of the central insert, and a flexible membrane having a first side, a second side opposite the first side, a profile complementary to the central aperture of the central insert, a post extending from the first side, and a central hole extending through the post and the first and second sides, the flexible membrane being disposed adjacent the central insert such that the stem of the central insert is disposed within the central hole of the flexible membrane and the second side of the flexible membrane abuts the biasing member of the central insert.

In an embodiment, the resistance breathing device also includes a face plate having an interior surface and an exterior surface opposite the interior surface of the face plate. The face plate overlays the central insert and is oriented such that the interior surface of the face plate faces the central insert. In an embodiment, the face plate includes a plurality of slots extending therethrough. In an embodiment, each of the plurality of slots is sized, shaped, and positioned so as to allow air to pass therethrough. In an embodiment, the face plate is fixed to the insert plate by at least one clip. In an embodiment, the face plate includes a retainer extending from the interior surface of the face plate. The retainer is sized, shaped, and positioned so as to abut the stem of the central insert.

In an embodiment, the central insert includes a handle that facilitates movement of the central insert between the first position and the second position. In an embodiment, the handle extends in a direction radially away from the axis of rotation. A ridge extends along a side of the handle facing the interior surface of the central insert. A plurality of grooves is formed in the insert plate. The ridge and each of the plurality of grooves are sized, shaped, and positioned in a complementary manner such that, when the central insert is in the first position, the ridge of the handle is positioned within a first one of the plurality of grooves, and such that, when the central insert is in the second position, the ridge of the handle is positioned within a second one of the plurality of grooves. In an embodiment, the handle includes a grip.

In an embodiment, the at least one inlet aperture of the insert plate includes three inlet apertures and the at least one inlet aperture of the central insert includes three inlet apertures. In an embodiment, the face mask and the insert plate are integrally formed. In an embodiment, the face mask is overmolded to the insert plate. In an embodiment, the face mask is made from a material including at least one of a rubber, a thermoplastic elastomer, silicone, styrene-ethylene/propylene-styrene, and styrene-ethylene/butylene-styrene. In an embodiment, the insert plate and the central insert are each made from a material including at least one of a polycarbonate plastic, a polypropylene plastic, and a nylon plastic. In an embodiment, the outer layer includes a fabric material. In an embodiment, the fabric material includes an elastic material.

BRIEF DESCRIPTION OF THE DRAWINGS

Reference is made to the following detailed description of the exemplary embodiment considered in conjunction with the accompanying drawings, in which.

DETAILED DESCRIPTION OF THE EXEMPLARY EMBODIMENTS

Figure 1:
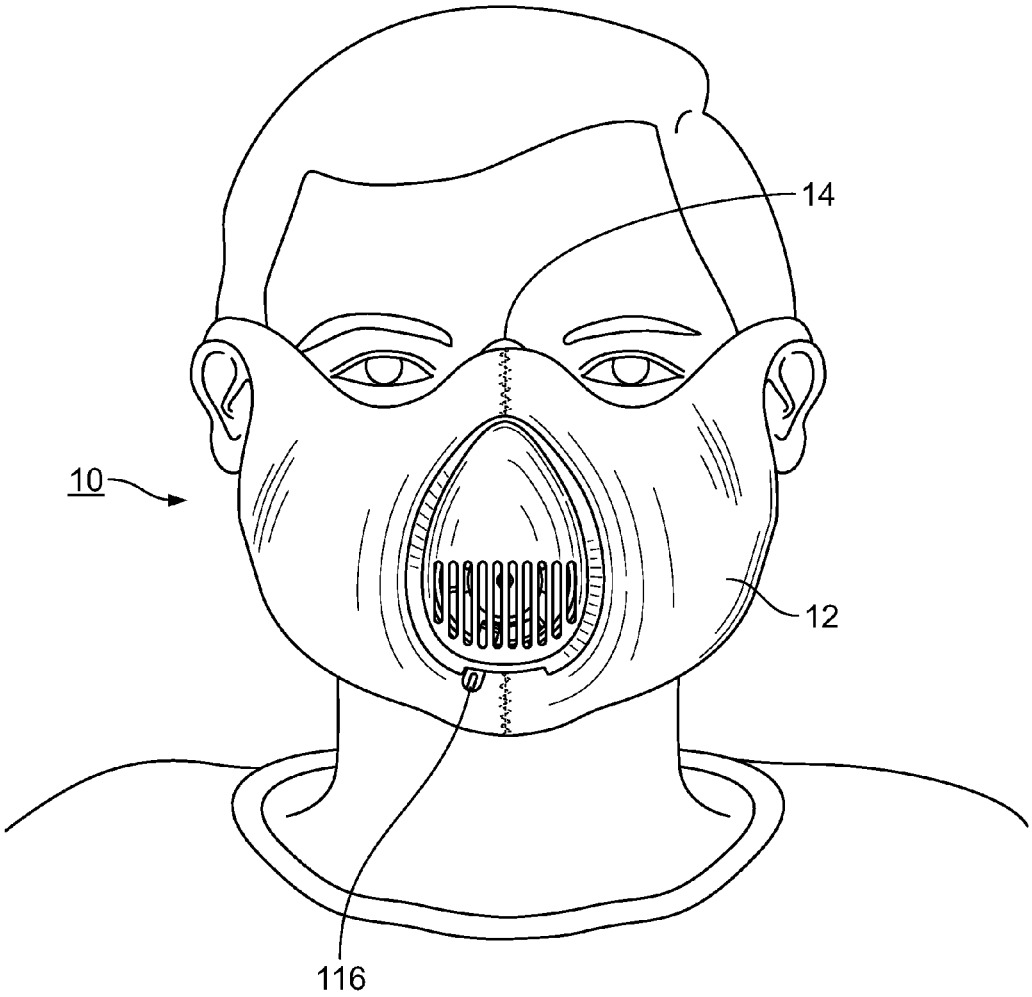
FIG. 1 is a front elevational view of a resistance breathing device in accordance with an exemplary embodiment of the present invention, said device being shown as worn by a user.
Figure 2:
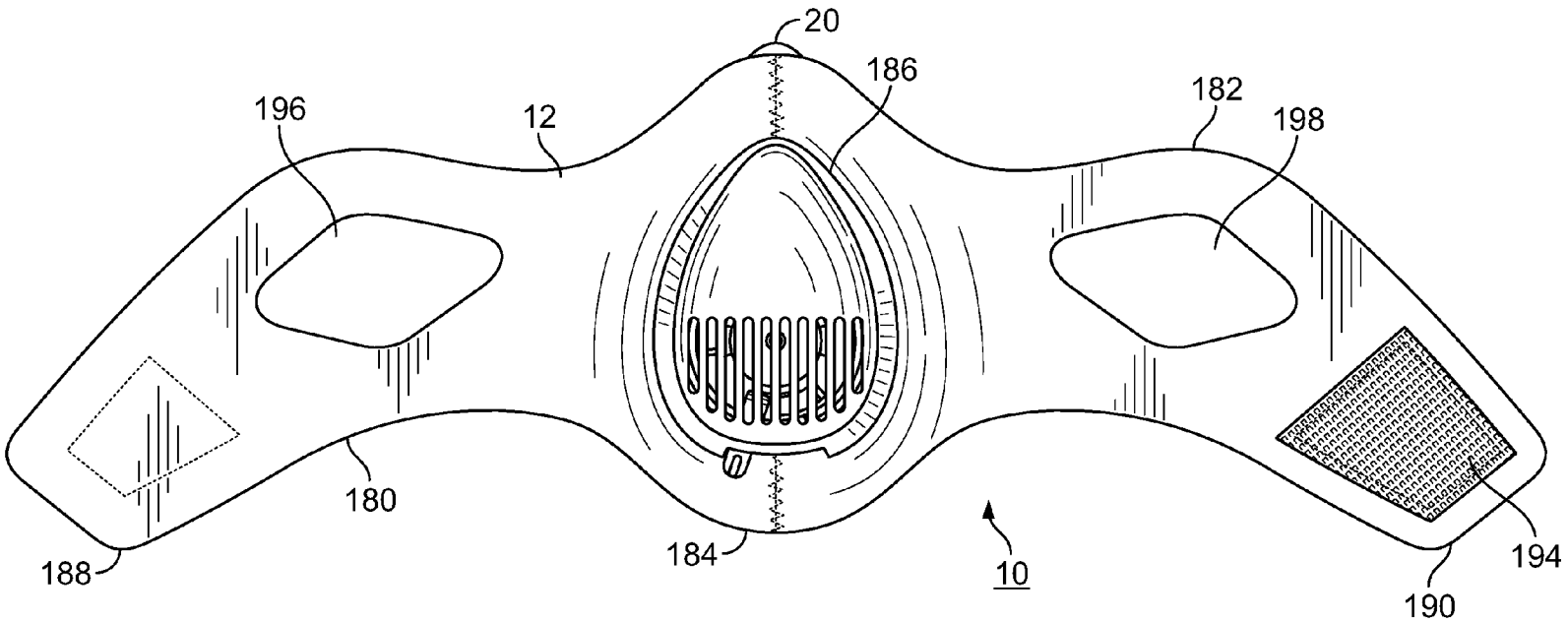
FIG. 2 is a front perspective view of the resistance breathing device shown in FIG. 1, but said device being shown as detached from the user.
Figure 3:
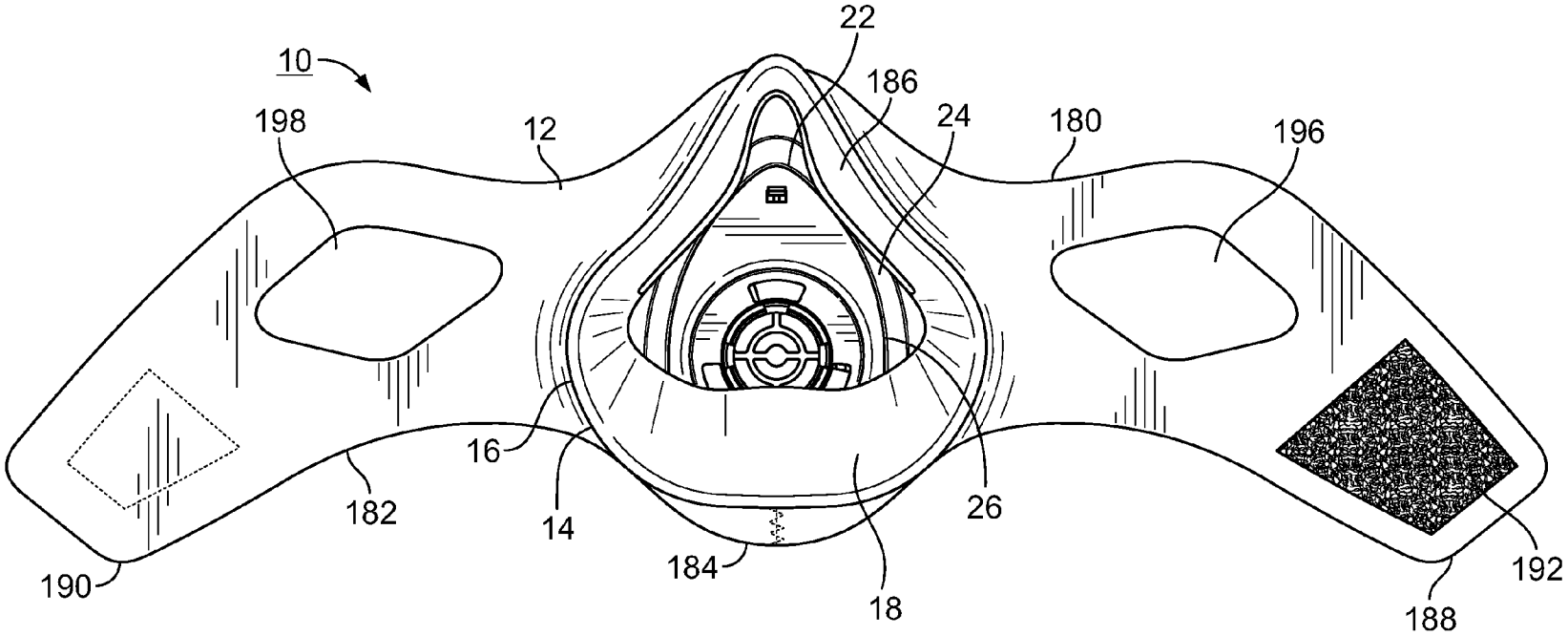
FIG. 3 is a rear perspective view of the resistance breathing device shown in FIG. 2.

FIGS. 1-5B illustrate an exemplary resistance breathing device 10 (hereinafter "device 10"). In an embodiment, the device 10 includes an outer layer 12 overlaying a centrally-located, air-impermeable face mask 14. In an embodiment, the face mask 14 is sized, shaped, and adapted to overlay the nose and mouth of a user. In an embodiment, the face mask 14 includes a perimeter 16 (as shown in FIG. 3) that is adapted to provide an air-tight seal with a user's face. In an embodiment, the face mask 14 is made from rubber. In another embodiment, the face mask 14 is made from thermoplastic elastomer ("TPE"). In another embodiment, the face mask 14 is made from silicone. In another embodiment, the face mask 14 is made from styrene-ethylene/propylene-styrene ("SEPS"). In another embodiment, the face mask 14 is made from styrene-ethylene/butylene-styrene ("SEBS"). In another embodiment, the face mask 14 is made from other suitable materials known in the art selected such that the perimeter 16 provides an air-tight seal with a user's face.

Referring now to FIGS. 2 and 3, in an embodiment, the face mask 14 includes an interior surface 18 and an exterior surface 20, a substantial portion of which is covered by the outer layer 12. Referring now to FIG. 4, in an embodiment, the face mask 14 includes an aperture 22 extending from the interior surface 18 to the exterior surface 20. In an embodiment, the aperture 22 is encircled by a lip 24. In an embodiment, the lip 24 includes a groove 26 formed therein and extending about the entirety thereof.

Figure 4A:
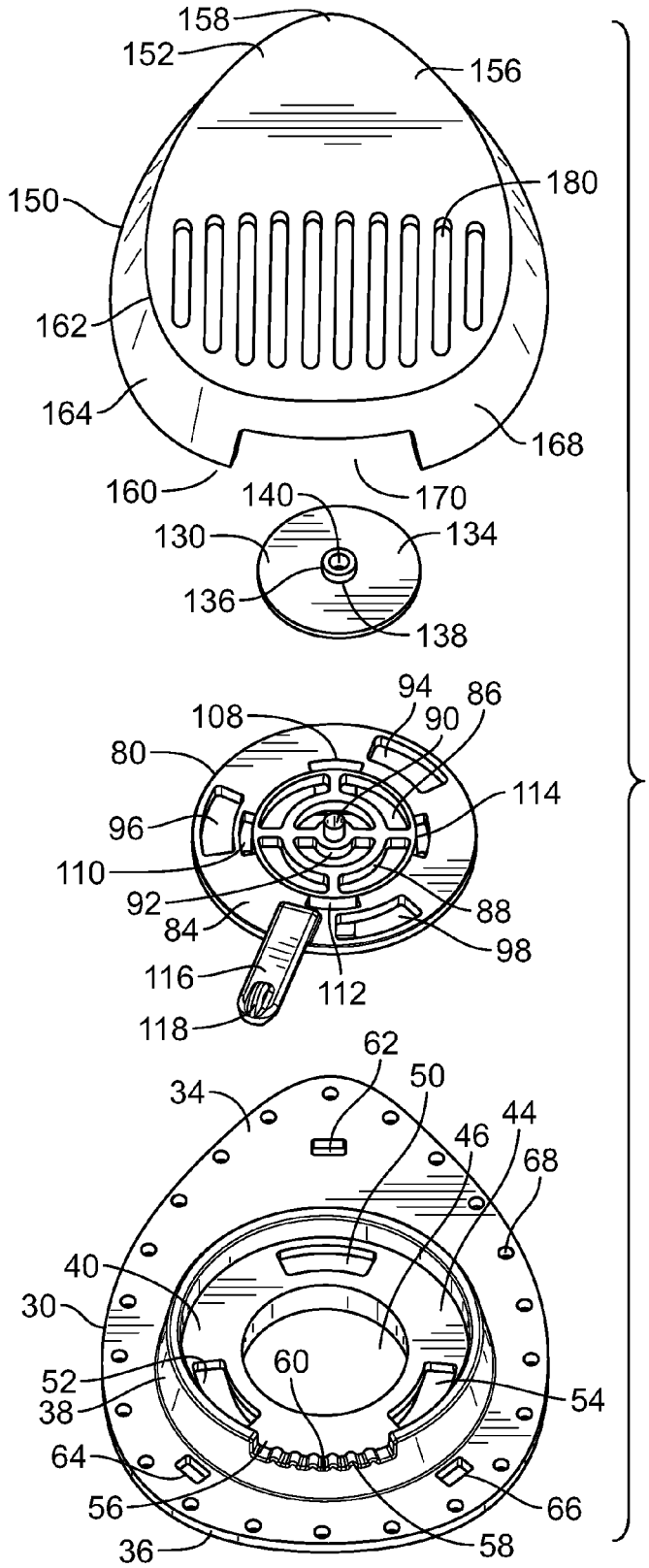
FIG. 4A is an exploded front perspective view of selected elements of the resistance breathing device shown in FIG. 2.
Figure 4B:
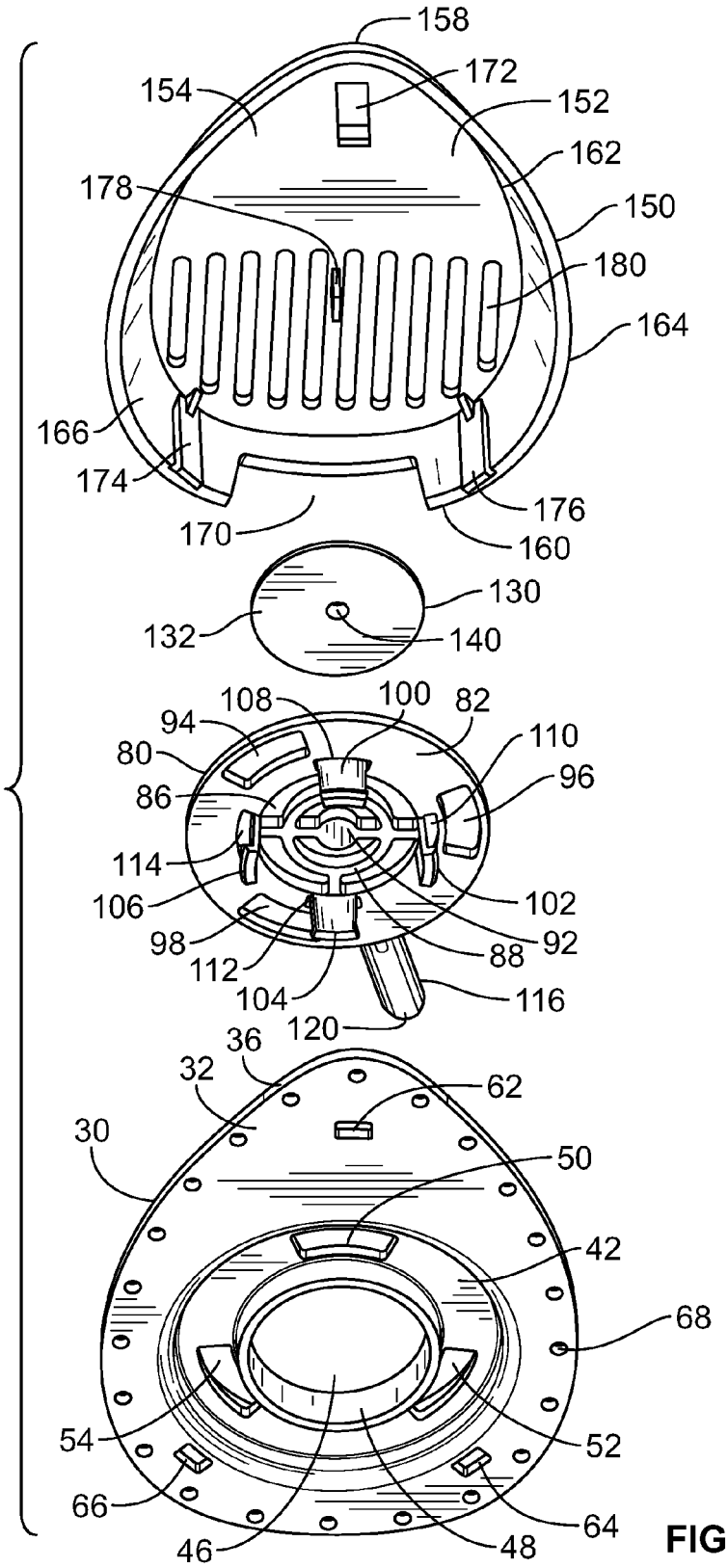
FIG. 4B is an exploded rear perspective view of the elements shown in FIG. 4A.

Referring now to FIGS. 4A and 4B, in an embodiment, the device 10 includes an insert plate 30 having an interior surface 32, an exterior surface 34, and a perimeter surface 36 encircling an entire perimeter of the interior and exterior surfaces 32, 34. In an embodiment, the insert plate 30 has a profile similar to a rounded triangle. In an embodiment, the insert plate 30 has a profile similar to that of a region overlaying a person's nose and mouth. In an embodiment, the perimeter surface 36 is adapted to engage the lip 24 of the face mask 14, thereby to retain the insert plate 30 therein. In an embodiment, an annular projection 38 extends from the exterior surface 34 of the insert plate 30. In an embodiment, the annular projection 38 may be frustoconical in shape (i.e., may be in the general shape of a truncated cone).

Continuing to refer to FIGS. 4A and 4B, in an embodiment, a central plate 40 extends across the annular projection 38. In an embodiment, the central plate 40 is substantially circular. The central plate 40 has an interior surface 42 and an exterior surface 44. In an embodiment, a central aperture 46 passes through the central plate 40 from the interior surface 42 to the exterior surface 44. In an embodiment, the central aperture 46 is substantially circular in shape. In an embodiment, an annular projection 48 extends from the interior surface 42 of the central plate 40 and surrounds the central aperture 46. In an embodiment, air inlets 50, 52, 54 pass through the central plate 40 from the interior surface 42 to the exterior surface 44. In an embodiment, the air inlets 50, 52, 54 are circumferentially arrayed and evenly spaced about the central aperture 46. In an embodiment, a truncation 56 is formed in the annular projection 38. In an embodiment, ridges 58 are formed in the truncation 56 and define valleys 60 therebetween.

Continuing to refer to FIGS. 4A and 4B, in an embodiment, slots 62, 64, 66 extend through the insert plate 30 from the interior surface 32 to the exterior surface 34 proximate the perimeter surface 36. In an embodiment, an array of holes 68 is formed in the insert plate 30, each of which extends through the insert 30 from the interior surface 34 proximate the perimeter surface 36. Each of the holes 68 is substantially the same size (e.g., diameter) and is positioned substantially the same distance from the perimeter surface 36, and the holes 68 are substantially evenly spaced from one another. The holes 68 are closer to the perimeter surface 36 than are the slots 62, 64, 66.

Continuing to refer to FIGS. 4A and 4B, in an embodiment, the device 10 also includes a central insert 80. In an embodiment, the central insert 80 is generally disc-shaped and has a circular profile. In an embodiment, the central insert 80 has an interior surface 82 and an exterior surface 84 opposite the interior surface 82. In an embodiment, a central aperture 86 is formed within the central insert 80 and extends therethrough from the interior surface 82 to the exterior surface 84. In an embodiment, the central aperture 86 is has a generally circular profile, the diameter of which is substantially similar to that of the circular profile of the central insert 80.

Continuing to refer to FIGS. 4A and 4B, in an embodiment, a biasing element 88 extends across the central aperture 86 of the central insert 80 proximate the exterior surface 84 of the central insert 80. In an embodiment, a stem 90 extends from a center 92 of the biasing element 88 in a direction perpendicularly and outwardly from the exterior surface 84. In an embodiment, air inlets 94, 96, 98 extend through the central insert 80 from the interior surface 82 to the exterior surface 84. In an embodiment, the air inlets 94, 96, 98 are circumferentially arrayed and evenly spaced about the central aperture 86 and are sized and shaped substantially similarly to the air inlets 50, 52, 54 of the insert plate 30.

Referring now to FIG. 4B, in an embodiment, clips 100, 102, 104, 106 extend from the interior surface 82 of the central insert 80. In an embodiment, the clips 100, 102, 104, 106 are positioned proximate to and evenly spaced about the central aperture 86 of the central insert 80. In an embodiment, the clips 100, 102, 104, 106 are sized and shaped such that, when the central insert 80 is positioned with respect to the insert plate 30 such that the interior surface 82 of the central insert 80 faces the exterior surface 44 of the central plate 40 of the insert plate 30, and such that the central aperture 86 of the central insert 80 is aligned with the central aperture 46 of the insert plate 30, and the central insert 80 and the insert plate 30 are moved toward one another until the interior surface 82 and the exterior surface 44 abut one another, the clips 100, 102, 104, 106 extend through the central aperture 46 of the insert plate 30 and engage the annular projection 48 of the insert plate 30 in a manner so as to retain the central insert 80 and the insert plate 30 in such abutting position.

Referring now to FIGS. 4A and 4B, in an embodiment, slots 108, 110, 112, 114 extend through the central insert 80 from the interior surface 82 to the exterior surface 84. In an embodiment, each of the slots 108, 110, 112, 114 is positioned adjacent a corresponding one of the clips 100, 102, 104, 106. In an embodiment, a handle 116 protrudes from the exterior surface 84 of the central insert 80 and extends radially outward with respect to the generally circular profile of the central insert 80. In an embodiment, a grip 118 protrudes from the handle 116 in a direction away from the exterior surface 84 of the central insert 80. In an embodiment, a ridge 120 protrudes from the handle 116 in an opposite direction from the grip 118 and toward the interior surface 82 of the central insert 80. In an embodiment, the ridge 120 is sized and shaped so as to fit within and be complementary to one of the valleys 60 of the insert plate 30. In the exemplary device 10, one handle 116 is present for positioning the central insert 80, but in other embodiments, a plurality of the handles 116 may be present.

Continuing to refer to FIGS. 4A and 4B, in an embodiment, the device 10 also includes a flexible, air-impermeable, disc-shaped diaphragm 130. In an embodiment, the diaphragm 130 has an interior surface 132 and an exterior surface 134 opposite the interior surface 132. In an embodiment, a profile of the diaphragm 130 is complementary to the central aperture 86 of the central insert 80. A tubular post 136 extends from the center 138 of the exterior surface 134. A central opening 140 extends through the diaphragm 130 from the interior surface 132 and through the tubular post 136. In an embodiment, the central opening 140 is sized and shaped to receive the stem 90 of the central insert 80 so as to enable the diaphragm 130 to be mounted on the central insert 80. In an embodiment, the tubular post 136 is formed integrally with the diaphragm 130 and extends generally perpendicularly from the exterior surface 134. In another embodiment, the tubular post 136 is a separate component from the diaphragm 130. In an embodiment, the diaphragm 130 is made of silicone.

Continuing to refer to FIGS. 4A and 4B, in an embodiment, the device 10 includes a face plate 150. The face plate 150 includes an outer plate 152 having an interior surface 154, an exterior surface 156 opposite the interior surface 154, an upper end 158, a lower end 160, and a perimeter 162 defining a profile that is generally similar to that of the insert plate 30. In an embodiment, the outer plate 152 is substantially planar. In an embodiment, the outer plate 152 is convex and curves in a direction away from the interior surface 154. A perimeter plate 164 extends from the perimeter 150 and away from the interior surface 154 of the outer plate 152 by a first distance. The perimeter plate 164 has an interior surface 166 and an exterior surface 168 opposite the interior surface 166. The perimeter plate 164 further includes a gap 170 proximate the lower end 160, within which the perimeter plate 164 extends away from the interior surface 154 by a second distance that is less than the first distance. The face plate 150 also includes clips 172, 174, 176 extending from the interior surface 154 of the outer plate 152. The clips 172, 174, 176 are sized, shaped, and positioned such that, when the face plate 150 is positioned over the insert plate 30 with the interior surface 154 of the outer plate 152 of the face plate 150 facing the exterior surface 44 of the central plate 40 of the insert plate 30 and the face plate 150 and the insert plate 30 are brought into contact with one another, the clips 172, 174, 176 engage the slots 62, 64, 66 of the insert plate 30, and thereby retain the face plate 150 and the insert plate 30 in proximity to one another.

Continuing to refer to FIGS. 4A and 4B, in an embodiment, a retainer 178 extends from the interior surface 154 of the face plate 150. In an embodiment, the retainer 178 is sized, shaped, and positioned such that, when the face plate 150 and the central insert 80 engage the face plate 30, the retainer 178 abuts the stem 90 of the central insert 80. In an embodiment, slots 180 extend through the outer plate 152 from the interior surface 154 to the exterior surface 156 thereof. In an embodiment, the slots 180 are positioned proximate the lower end 160 of the outer plate 152. In an embodiment, the face plate 150 is contoured to provide an aesthetically pleasing appearance to the device 150. In an embodiment, the slots 180 are sized and shaped so as to hide the internal elements of the device 10 (i.e., the insert plate 30, the central insert 80, and the diaphragm 130) from view. In an embodiment, the retainer 178 is positioned such that it extends from a point on the interior surface 154 between two of the slots 180.

In an embodiment, the insert plate 30, the central insert 80, and the face plate 150 are made from a polycarbonate ("PC") plastic. In an embodiment, the insert plate 30, the central insert 80, and the face plate 150 are made from a nylon plastic. In an embodiment, the insert plate 30, the central insert 80, and the face plate 150 are made from a polypropylene plastic. In an embodiment, the insert plate 30, the central insert 80, and the face plate 150 are made from another material selected such that they are capable of use as described herein. In an embodiment each of the insert plate 30, the central insert 80, and the face plate 150 is made a material that is different from one another. In an embodiment, at least one of the insert plate 30, the central insert 80, and the face plate 150 is made from a translucent material. In an embodiment, at least one of the insert plate 30, the central insert 80, and the face plate 150 is made from an opaque material.

Referring back to FIGS. 2 and 3, in an embodiment, the outer layer 12 includes straps 180, 182 extending in opposite directions away from a central portion 184. In an embodiment, the central portion 184 includes an aperture 186 that is sized and shaped to surround the face mask 14 and retain the face mask 14 therein, as will be described in further detail below with reference to assembly of the device 10. In an embodiment, the outer layer 12 is made from a fabric material. In an embodiment, the outer layer 12 is made from an elastic material. In an embodiment, the size of the outer layer 12 is adjustable (e.g., the lengths of the straps 180, 182 are adjustable). In an embodiment, the straps 180, 182 include corresponding ends 188, 190. In an embodiment, the ends 188, 190 of the straps 180, 182 incorporate corresponding hook and loop fasteners 192, 194 to enable the ends 188, 190 to be secured to one another, thereby to enable the device 10 to be affixed about the user's head (see, e.g., FIG. 1). In other embodiments, the ends 188, 190 of the straps 180, 182 include other securing means known in the art, such as clips, press-fit snaps, buttons, or the like. In an embodiment, the straps 180, 182 include cutouts 196, 198 for seating around the user's ears to further secure the device 10 to the user's face.

Referring now to FIGS. 4A-5B, assembly of the device 10 is described. In an embodiment, the face mask 14 and the insert plate 30 are integrally formed with one another by an overmolding process. When the face mask 14 and the insert plate 30 are so formed, the entire periphery of the perimeter surface 36 of the insert plate 30 is disposed within the groove 26 of the lip 24 of the face mask 14, and the material of the face mask 14 extends through each of the holes 68 that are formed in the insert plate 30. The elastic nature of the face mask 14, coupled with the overmolding as described above, retains the insert 30 within the aperture 22 (and, more particularly, within the groove 26) in an engagement that is air-tight and structurally secure. However, for clarity of illustration, the face mask 14 is not shown in FIGS. 4A-5B.

Continuing to refer to FIGS. 4A-5B, the central insert 80 is affixed to the insert plate 30 by aligning the handle 116 of the central insert 80 with the truncation 56 of the insert plate 30 and pressing the clips 100, 102, 104, 106 of the central insert 80 through the central aperture 46 of the insert plate 30. When pressed into the central aperture 46 of the insert plate 30, the clips 100, 102, 104, 106 flex inward (i.e., toward one another) to permit passage therethrough. Once the clips 100, 102, 104, 106 have passed through the central aperture 46 of the insert plate 30 and the interior surface 82 of the central insert 80 abuts the exterior surface 44 of the central plate 40 of the insert plate 30, the clips 100, 102, 104, 106 return to their original unflexed position. In such position, the handle 116 of the central insert 80 rests within the truncation 56 of the insert plate 30. The central insert 80 may rotate with respect to the insert plate 30 about an axis of rotation defined by the centers of the central apertures 46, 86 and perpendicular to the central apertures 46, 86. Such rotation is bounded by the travel of the handle 116 between the two ends of the truncation 56. The central insert 80 is otherwise restricted from moving or rotating with respect to the insert plate 30. The clips 100, 102, 104, 106 retain the central insert 80 and the insert plate 30 in sufficiently close alignment to one another such that they form an airtight seal with one another. Consequently, air cannot pass around the central insert 80 and through any of the apertures of the central plate 40 (i.e., the central aperture 46 and the air inlets 50, 52, 54).

Continuing to refer to FIGS. 4A-5B, the diaphragm 130 is engaged to the central insert 80 by inserting the stem 90 of the central insert 80 through the opening 140 within the post 136 of the diaphragm 130 such that the interior surface 132 of the diaphragm 130 abuts the biasing element 88 of the central insert 80. Referring now to FIGS. 4A and 4B, the face plate 150 is engaged to the insert plate 30 by engaging each of the clips 172, 174, 176 of the face plate 150 with a corresponding one of the slots 62, 64, 66 of the insert plate 30. When the face plate 150 is so positioned, the retainer 178 of the face plate 150 abuts the stem 90 of the central insert 80, thereby preventing the diaphragm 130 from sliding motion along the stem 90 and retaining the interior surface 132 of the diaphragm 130 in a position abutting the biasing element 88 of the central insert 80.

As noted above, in an embodiment, the insert plate 30 and the face mask 14 are overmolded and integrally formed with one another. In another embodiment, the insert plate 30 and the face mask 14 may be separately formed and removably engaged with one another. In such an embodiment, the assembled combination of the insert plate 30, the central insert 80, the diaphragm 130, and the face plate 150 is engaged to the face mask 14 by placing the insert plate 30 within the aperture 22 of the face mask 14 and positioning the entire periphery of the perimeter surface 36 of the insert plate 30 within the groove 26 of the lip 24 of the face mask 14, in which position the face mask 14 forms an air-tight seal around the insert plate 30. In another embodiment including a separately formed insert plate 30 and face mask 14, the insert plate 30 and the face mask 14 may be engaged to one another, as described above, prior to engaging the central insert 80 and the other elements of the device 10 to the insert plate 30.

Referring now to FIGS. 2-3, the outer layer 12 is laid over the face mask 14, which has the assembled combination of the insert plate 30, the central insert 80, the diaphragm 130, and the face plate 150 retained therein. The aperture 186 of the outer layer 12 is stretched and pulled over the assembled combination of the face plate 150, the central insert 80, and the insert plate 30 until the outer layer 12 abuts the face mask 14. The outer layer 12 is then allowed to return to its relaxed (i.e., unstretched) size such that the aperture 186 of the outer layer 12 is held between the face mask 14 and the insert plate 30, in which position the outer layer 12 retains the remaining elements of the device in the aperture 186.

Referring now to FIGS. 1-5B, use of the exemplary device 10 by a user according to an exemplary embodiment will now be described. Initially, the device 10 is affixed to the user's face by placing the face mask 14 over the user's mouth and nose, passing the straps 180, 182 around either side of the user's head such that cutouts 196, 198 overlap the user's ears, and securing the ends 188, 190 to one another using the hook and loop fasteners 192, 194. The user may adjust the hook and loop fasteners 192, 194 to ensure that the face mask 14 is pulled against the user's face with sufficient force such that the perimeter 16 is pressed tightly against the user's face and around the user's mouth and nose. By such action, an airtight seal is created between the user's face and the face mask 14, thereby ensuring that air can only pass in and out for the user's inhalation and exhalation through the various apertures formed within the insert plate 30.

Figure 5A:
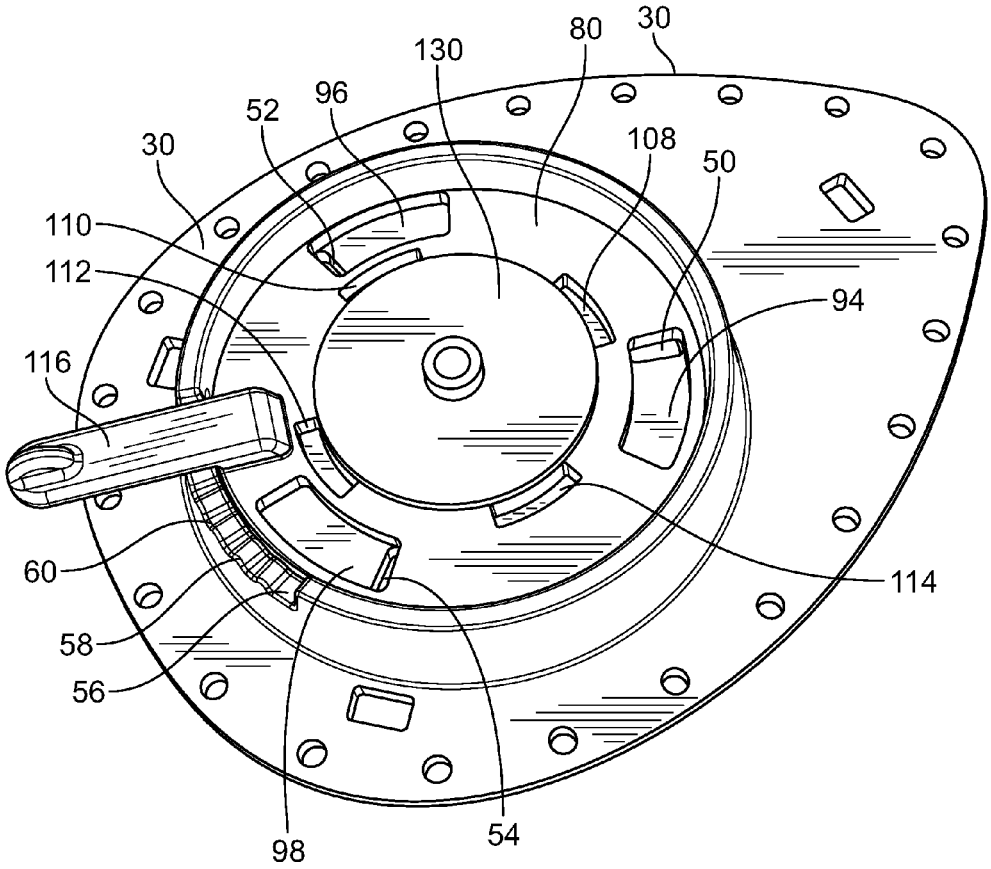
FIG. 5A is an assembled front elevational view of some of the elements shown in FIG. 4A, said elements being configured in a first manner.
Figure 5B:
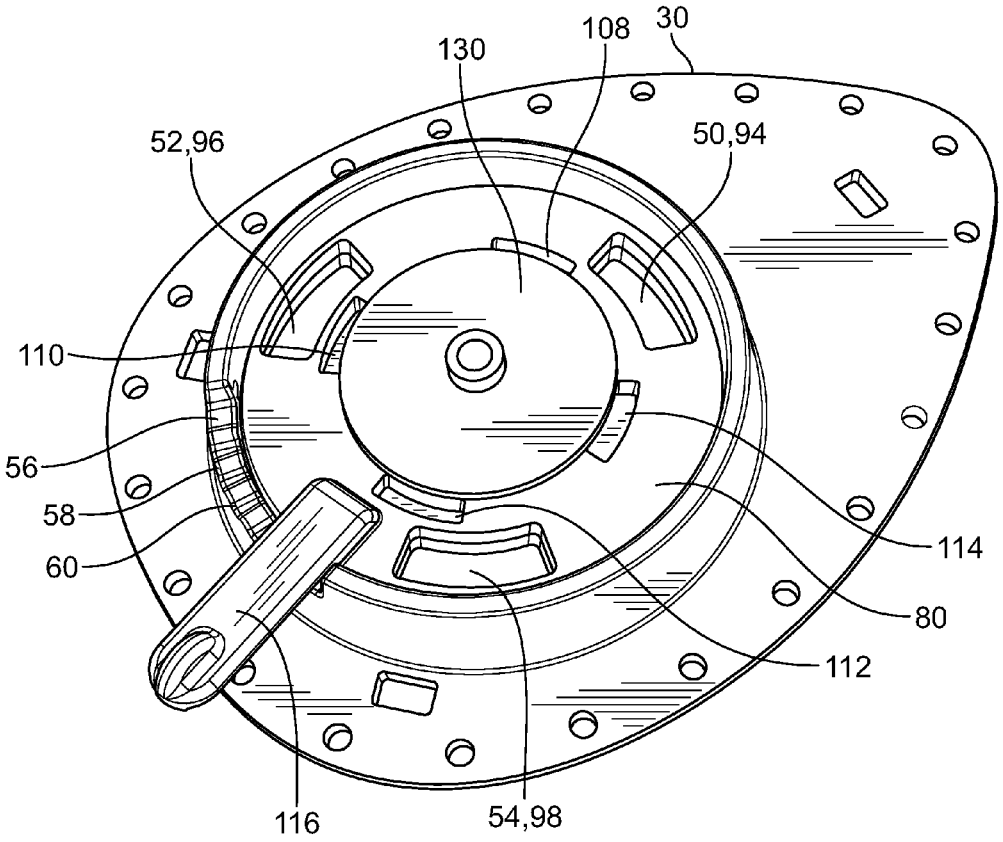
FIG. 5B is an assembled front elevational view of the elements shown in FIG. 5A, said elements being configured in a second manner.

Referring now to FIGS. 5A and 5B, adjustment of the exemplary device 10 by a user will now be described. More particularly, FIGS. 5A and 5B illustrate certain elements of the device 10 (i.e., the insert plate 30, the central insert 80, and the diaphragm 130) with remaining elements of the device 10 (including, most relevantly, the face plate 150) omitted for clarity. FIG. 5A shows a first orientation of the central insert 80 with respect to the insert plate 30. The handle 116 is positioned at a first end of the truncation 56 of the insert plate 30; consequently, the ridge 120 of the handle 116 is positioned within one of the valleys 60 of the insert plate 30 that is closest to the first end of the truncation 56. In such position, each of the air inlets 94, 96, 98 of the central insert 80 is aligned with respect to a corresponding one of the air inlets 50, 52, 54 of the insert plate 30 such that only small portions of the air inlets 94, 96, 98 overlap corresponding small portions of the air inlets 50, 52, 54. Consequently, only a small volume of air may pass through the aligned pairs of the air inlets 94, 96, 98 with corresponding ones of the air inlets 50, 52, 54.

In some circumstances, the user may wish to increase the volume of air that may pass into the face mask 14. In this case, the user may grasp the handle 116 of the central insert 80, with the grip 118 aiding the user's ability to manipulate the handle 116 and thereby the central insert 80, and may use the handle 116 to rotate the central insert 80 with respect to the insert plate 30. The slots 108, 110, 112, 114 of the central insert 80 may reduce the surface area of the interior surface 82 of the central insert 80 that abuts the exterior surface 44 of the central plate 40 of the insert plate 30, thereby reducing friction between such surfaces and facilitating such rotation. Because the air inlets 50, 52, 54 of the insert plate 30 and the air inlets 94, 96, 98 of the central insert 80 are circumferentially arrayed about the axis of rotation, such rotation may increase or decrease the portions of the air inlets 94, 96, 98 of the central insert 80 that are aligned with the corresponding ones of the air inlets 50, 52, 54 of the insert plate 30. If the user wishes to allow a maximal degree of air flow into the face mask 14, the user may rotate the handle 116 until it is positioned at a second end of the truncation 56 of the insert plate 30. In such position, the ridge 120 of the handle 116 is positioned within one of the valleys 60 of the insert plate 30 that is closest to the second end of the truncation 56. FIG. 5B shows the central insert 80 as positioned after such rotation. In such position, each of the air inlets 94, 96, 98 of the central insert 80 is completely aligned with a corresponding one of the air inlets 50, 52, 54 of the insert plate 30. Consequently, a comparatively large volume of air may pass through the aligned pairs of the air inlets 94, 96, 98 with corresponding ones of the air inlets 50, 52, 54.

In some circumstances, the user may wish to allow an intermediate volume of air to pass into the face mask 14. In this case, the user may use the handle 116 to rotate the central insert 80 with respect to the insert plate 30 such that the handle 116 and, consequently, the central insert 80 are positioned intermediate the positions shown in FIGS. 5A and 5B. When the handle 116 is so positioned, the ridge 120 of the handle 116 is positioned within an intermediate one of the valleys 60 of the insert plate 30. When the central insert 80 is so positioned, larger portions of the air inlets 94, 96, 98 than those shown in FIG. 5A overlap correspondingly larger portions of the air inlets 50, 52, 54. Consequently, a volume of air allowed to pass through the aligned pairs of the air inlets 94, 96, 98 with corresponding ones of the air inlets 50, 52, 54 will be greater than that allowed when the central insert 80 is positioned as shown in FIG. 5A, but less than that allowed when the central insert 80 is positioned as shown in FIG. 5B.

Continuing to refer to FIGS. 1-5, when the user inhales, a reduced air pressure is induced within the face mask 14 as compared to the surrounding atmosphere. This reduced air pressure urges the membrane 130 against the biasing element 88, in which position the membrane 130 completely overlaps and seals the central aperture 86 of the central insert 80. Due to such sealing, and to the similar sizes and close alignment of the central insert 80 and the central plate 40 of the insert plate 30, air cannot pass from the user's surroundings to within the face mask 14 through the aligned combination of the central aperture 86 of the central insert 80 and the central aperture 46 of the insert plate 30. As a result, the only air that can pass from the user's surroundings to within the face mask 14 is air allowed to pass through the aligned pairs of each of the air inlets 94, 96, 98 of the central insert 80 with a corresponding one of the air inlets 50, 52, 54 of the insert plate 30. As described above, the user of the device 10 may configure the size of the portions of each of the air inlets 94, 96, 98 of the central insert 80 to be aligned with the corresponding one of the air inlets 50, 52, 54 of the insert plate 30 by adjusting the position of the handle 116 to rotate the central insert 80 with respect to the insert plate 30. Therefore, by adjusting the position of the handle 116, the user of the device 10 may control the amount of air that the device 10 allows him or her to inhale.

Continuing to refer to FIGS. 1-5B, when the user exhales, an increased air pressure is induced within the face mask 14 as compared to the surrounding atmosphere. This increased air pressure urges the membrane 130 away from the biasing element 88, in which position the membrane 130 does not seal the central aperture 86 of the central insert 80. Due to such lack of sealing, exhaled air can freely pass from within the face mask 14 to the user's surroundings through the central aperture 46 of the insert plate 30, the central aperture 86 of the central insert 80, and the slots 180 of the face plate 150. Because the combination of the membrane 130, the biasing element 88, the central aperture 46, and the central aperture 86 cooperate to allow the user exhale freely therethrough, while preventing air inhalation therethrough, this combination of elements may be considered to form an air exhaust valve assembly.

In the exemplary device 10, the handle 116 may be used to position the central insert 80, thereby to align selected portions of the air inlets 94, 96, 98 with the air inlets 50, 52, 54 and configure the amount of air that is allowed to flow into the face mask 14. In other embodiments, the user may configure allowable air flow into the face mask 14 in a different manner. For example, in another embodiment, the central insert 80 may be subdivided into separate elements such that the air inlets 94, 96, 98 may be positioned independently from one another, allowing the user a wider variety of options in customizing the air flow into the face mask 14. In another embodiment, the quantity of the air inlets 50, 52, 54 and the air inlets 94, 96, 98 may vary, i.e., the insert plate 30 may include less than or greater than three of the air inlets 50, 52, 54 and the central insert 80 may include less than or greater than three of the air inlets 94, 96, 98.

The exemplary resistance breathing device 10 restricts the volume of air that can be inhaled by a user during ventilation to the volume of air that can pass through the portions of the air inlets 94, 96, 98 of the central insert 80 that overlap corresponding ones of the air inlets 50, 52, 54 of the insert plate 30. Consequently, the resistance breathing device 10 restricts the oxygen available to the user's body when the device 10 is worn by the user. Users who wear the resistance breathing device 10 during physical training may realize improved benefits from such physical training due to such restriction. Moreover, because the user may select the position of the central insert 80 as described above, and thereby select the sizes of the portions of the air inlets 94, 96, 98 of the central insert 80 that overlap corresponding ones of the air inlets 50, 52, 54 of the insert plate 30, the user may select the degree of restriction of inhalation of oxygen to be provided by the resistance breathing device 10.

As the user of the device 10 moves the handle 116, the central insert 80 moves smoothly while the ridge 120 is aligned with one of the ridges 58. Conversely, additional applied force is required to initiate rotation while the ridge 120 is aligned with, and settled within, one of the valleys 60 because of the complementary sizing therebetween. As a result, the central insert 80 may feel "settled" in place when aligned with one of the valleys 60, and the valleys 60 may define a plurality of discrete positions of the insert 80. This tactile sensation may serve as a guide to the user of the device 10 in adjusting the position of the central insert 80, particularly when the device 10 has already been fastened about the user's head and cannot readily be seen by the user. Further, each discrete position of the central insert 80 with respect to the insert plate 30 will result in a corresponding alignment of a portion of the air inlets 94, 96, 98 of the central insert 80 with corresponding ones of the air inlets 50, 52, 54 and, consequently, a corresponding allowed degree of air flow into the face mask 14, as will be described in further detail hereinafter. Consequently, the user may more easily configure the device 10 to allow a desired degree of air flow into the face mask 14 (e.g., the same degree as used in a previous workout; a greater restriction of air flow into the face mask 14 than a previous workout) through tactile sensation alone, without the need to remove the device 10 for visual inspection.

It will be understood that the embodiments described herein are merely exemplary and that a person skilled in the art may make many variations and modifications without departing from the spirit and scope of the invention. All such variations and modifications are intended to be included within the scope of the invention, as embodied in the appended claims presented.

What is claimed is:

1. A resistance breathing device, comprising:

a face mask having an interior surface, an exterior surface opposite said interior surface, an aperture extending through said face mask from said exterior surface to said interior surface, and a perimeter, wherein said face mask is adapted to overlay a user's mouth and nose such that said perimeter forms an air-tight seal with the user's face and around the user's mouth and nose and said face mask defines an internal area between said interior surface of said face mask and the user's face;

an outer layer overlaying said face mask and having a pair of straps with inter-engaging ends for affixing said face mask about the user's face;

an insert plate having an interior surface, an exterior surface opposite said interior surface of said insert plate, and at least one inlet aperture extending therethrough, said insert plate being disposed within said aperture of said face mask, said aperture of said face mask forming an air-tight seal around said insert plate;

a central insert including an interior surface, an exterior surface opposite said interior surface of said central insert, and at least one inlet aperture extending therethrough, said central insert overlaying said insert plate such that said interior surface of said central insert faces said exterior surface of said insert plate and such that at least a portion of said at least one inlet aperture of said central insert overlays said at least one inlet aperture of said insert plate, said central insert being movable with respect to said insert plate between at least a first position and a second position, wherein when said central insert is in said first position, a first portion of said at least one inlet aperture of said central insert overlays said at least one inlet aperture of said insert plate, and wherein when said central insert is in said second position, a second portion of said at least one inlet aperture of said central insert overlays said at least one inlet aperture of said insert plate, said second portion of said at least one inlet aperture of said central insert being larger in size than said first portion of said at least one inlet aperture of said central insert; and an air exhaust valve assembly adapted to prevent air from passing therethrough from an external environment to said internal area, said at least one air exhaust valve assembly being adapted to allow air to pass therethrough from said internal area of said face mask to the external environment, wherein said central insert id moveable rotationally about an axis of rotation and relative to said insert plate, wherein said at least one inlet aperture of said inlet plate and said at least one inlet aperture of said central insert are circumferentially arrayed about the axis of rotation, wherein said central insert includes a handle that facilitates movement of said central insert between said first position and said second position, and wherein said handle extends in a direction radially away from said axis of rotation, wherein a ridge extends along a side of said handle facing said interior surface of said central insert, and wherein a plurality of grooves is formed in said insert plate, said ridge and each of said plurality of grooves being sized, shaped, and positioned in a complementary manner such that, when said central insert is in said first position, said ridge of said handle is positioned within a first one of said plurality of grooves, and such that, when said central insert is in said second position, said ridge of said handle is positioned within a second one of said plurality of grooves.

2. The resistance breathing device of claim 1, wherein said face mask is made from a material including at least one of a rubber, a thermoplastic elastomer, silicone, styrene-ethylene/propylene-styrene, and styrene-ethylene/butylene-styrene.

3. The resistance breathing device of claim 1, wherein said insert plate and said central insert are each made from a material including at least one of a polycarbonate plastic, a polypropylene plastic, and a nylon plastic.

4. The resistance breathing device of claim 1, wherein said outer layer includes a fabric material.

5. The resistance breathing device of claim 4, wherein said fabric material includes an elastic material.

6. A resistance breathing device, comprising:

a face mask having an interior surface, an exterior surface opposite said interior surface, an aperture extending through said ace mask from said exterior surface to said interior surface, and a perimeter, wherein said face mask is adapted to overlay a user's mouth and nose such that said perimeter forms an air-tight seal with the user's face and around the user's mouth and nose and said face mask defines an internal area between said interior surface of said face mask and the user's face;

an outer layer overlaying said face mask and having a pair of straps with inter-engaging ends for affixing said face mask about the user's face;

an insert having at least one inlet aperture extending therethrough, said insert being disposed within said aperture of said face mask, said aperture of said face mask forming an air-tight seal around said insert;

an adjustment element including at least one inlet aperture extending therethrough, said adjustment element being movably attached to said insert such that said adjustment element is movable with respect to said insert between at least a first position and a second position, wherein when said adjustment element is in said first position, a first at least a portion of at least one of said at least one inlet aperture of said adjustment element overlays a first at least a portion of at least one of said at least one inlet aperture of insert, and wherein when said adjustment element is in said second position, a second at least a portion of at least one of said at least one inlet aperture of said adjustment element overlays a second at least a portion of at least one of said at least one inlet aperture of said insert, said second at least a portion of said at least one of said at least one inlet aperture of said adjustment element being larger in size than said first at least a portion of said at least one of said at least one inlet aperture of said adjustment element; and an air exhaust valve assembly adapted to prevent air from passing therethrough from an external environment to said internal area, said at least one air exhaust valve assembly being adapted to allow air to therethrough from said internal area of said face mask to the external environment, wherein said adjustment element is movable rotationally about an axis of rotation and relative to said insert, wherein said adjustment element includes a handle that facilitates movement of said adjustment element between said first position and said second position, and wherein said handle extends in a direction radially away from the axis of rotation, wherein a ridge extends along a side of said handle facing said insert, and wherein a plurality of grooves is formed in said insert, said ridge and each of said plurality of grooves being sized, shaped, and positioned in a complementary manner such that, when said adjustment element Is in said first position, said ridge of said handle is positioned within a first one of said plurality of grooves, and such that, when said adjustment element is in said second position, said ridge of said handle is positioned within a second one of said plurality of grooves.

7. The resistance breathing device of claim 6, wherein said at least one inlet aperture of said adjustment element and said at least one inlet aperture of said insert are circumferentially arrayed about the axis of rotation.

8. The resistance breathing device of claim 6, wherein said handle includes a grip.

9. The resistance breathing device of claim 6, wherein said adjustment element is attached to said insert by at least one clip.

10. The resistance breathing device of claim 6, wherein said at least one inlet aperture of said insert includes a plurality of inlet apertures and said at least one inlet aperture of said adjustment element includes a plurality of inlet apertures.

11. The resistance breathing device of claim 10, wherein said plurality of inlet apertures of said insert includes three inlet apertures and said plurality of inlet apertures of said adjustment element includes three inlet apertures.

12. The resistance breathing device of claim 6, wherein said face mask and said insert are integrally formed.

13. The resistance breathing device of claim 12, wherein said face mask is overmolded to said insert.

14. The resistance breathing device of claim 6, wherein said insert includes a central aperture, and wherein said adjustment element includes a central aperture overlaying said central aperture of said insert plate and having a profile complementary to said central aperture of said insert plate, a biasing member extending across said central aperture of said adjustment element, and a stem extending from a center of said biasing member and away from said insert.

15. The resistance breathing device of claim 14, wherein said air exhaust valve assembly includes said central aperture of said insert, said central aperture of said adjustment element, and a flexible membrane having a first side, a second side opposite said first side, a profile complementary to said central aperture of said central insert, a post extending from said first side, and a central hole extending through said post and said first and second sides, said flexible membrane being disposed adjacent said adjustment element such that said stem of said adjustment element is disposed within said central hole of said flexible membrane and said second side of said flexible membrane abuts said biasing member of said adjustment element.

16. The resistance breathing device of claim 15, further comprising a face plate having an interior surface and an exterior surface opposite said interior surface of said face plate, said face plate overlaying said insert and being oriented such that said interior surface of said face plate faces said insert.

17. The resistance breathing device of claim 16, wherein said face plate includes a retainer extending from said interior surface of said face plate, said retainer being sized, shaped, and positioned so as to abut said stem of said adjustment element.

18. The resistance breathing device of claim 17, wherein said face plate includes a plurality of slots extending therethrough, said retainer of said face plate being located between a first one of said plurality of slots and a second one of said plurality of slots.

19. The resistance breathing device of claim 18, wherein each of said plurality of slots is sized, shaped, and positioned so as to allow air to pass therethrough.

20. The resistance breathing device of claim 19, wherein said face plate is fixed to said insert by at least one clip.

* * * * *